US005978645A

United States Patent [19]

Miyazaki

[11] Patent Number: 5,978,645

[45] Date of Patent: Nov. 2, 1999

[54] HEAT ROLLER FIXING DEVICE HAVING CURL CORRECTION MECHANISM

[75] Inventor: Akio Miyazaki, Niigata, Japan

[73] Assignee: NEC Corporation, Tokyo, Japan

[21] Appl. No.: 09/140,653

[22] Filed: Aug. 26, 1998

[30] Foreign Application Priority Data

Aug. 27, 1997 [JP] Japan ..... 9-231382

[51] Int. Cl.[6] ..... G03G 15/20; G03G 21/00

[52] U.S. Cl. ..... 399/406; 399/322; 493/459

[58] Field of Search ..... 399/406, 75, 322, 399/328; 271/161, 188, 209; 493/459

[56] References Cited

U.S. PATENT DOCUMENTS

| | | | |
|---|---|---|---|
| 5,123,895 | 6/1992 | Mandel | 493/459 |
| 5,258,815 | 11/1993 | Nakagawa et al. | 399/406 |
| 5,396,318 | 3/1995 | Asada | 399/328 |
| 5,422,710 | 6/1995 | Shirasaka et al. | 399/322 |

FOREIGN PATENT DOCUMENTS

| | | |
|---|---|---|
| 7-33280 | 2/1995 | Japan . |
| 7-97116 | 4/1995 | Japan . |
| 7-137912 | 5/1995 | Japan . |
| 7-179258 | 7/1995 | Japan . |
| 7-237804 | 9/1995 | Japan . |
| 8-225219 | 9/1996 | Japan . |
| 8-227188 | 9/1996 | Japan . |
| 8-290857 | 11/1996 | Japan . |
| 8-314317 | 11/1996 | Japan . |

*Primary Examiner*—Arthur T. Grimley
*Assistant Examiner*—Sophia S. Chen
*Attorney, Agent, or Firm*—Sughrue, Mion, Zinn, Macpeak & Seas, PLLC

[57] ABSTRACT

A heat roller fixing device includes a heat roller, a press roller, and at least one curl correction mechanism. The curl correction mechanism is constituted by three discharge rollers that form an S-shaped nip portion. The curl correction mechanism is arranged on a recording medium discharge side of a fixing nip portion which is formed at a contact portion between the heat roller and the press roller.

13 Claims, 2 Drawing Sheets

HEAT ROLLER FIXING DEVICE HAVING CURL CORRECTION MECHANISM

BACKGROUND OF THE INVENTION

The present invention relates to a heat roller fixing device used in an electrophotographic image forming apparatus and, more particularly, to a heat roller fixing device having a curl correction mechanism.

In an electrophotographic image forming apparatus such as a printer, a toner image is transferred from a photosensitive drum to a recording medium by an image forming portion, and thereafter the transferred toner image is fixed to the recording medium by using a fixing device.

As a fixing device of this type, a heat roller fixing device is conventionally used which has a heat roller controlled at a predetermined temperature and a press roller having elasticity. A recording medium formed with a non-fixed toner image is passed through a fixing nip portion formed at the contact portion between these rollers, and is heated and pressed, thereby fixing the non-fixed toner image to the recording medium.

Since the heat roller fixing device heats the recording medium, a phenomenon in which the recording medium is curled to the heat roller side by heat occurs.

Due to this curl, the recording medium after fixing is not sometimes taken by a convey roller to cause jam of the recording medium on the convey path. This leads to the problem of degraded convey reliability.

In double-sided printing, curl that occurs after upper surface printing adversely affects an image on the leading end side in lower surface printing.

For this reason, when a heat roller fixing device is used, a mechanism that corrects the curl is required. A heat roller fixing device having a curl correction mechanism as follows is conventionally used accordingly.

For example, a method as indicated in Japanese Patent Laid-Open No. 8-314317 is employed in a fixing device in which a heater is brought into slidable contact with a fixing film and which has a press roller on the other side. A paper discharge lower guide, which regulates the convey direction of the recording medium immediately after the recording medium passes through a fixing nip portion is provided. The paper discharge lower guide is vertically moved to correct the curl of the recording medium that has passed through the fixing nip portion.

In a fixing device constituted by a heat roller and a press roller, as indicated in, e.g., Japanese Patent Laid-Open No. 8-290857, a discharge roller pair is arranged on the downstream side in the convey direction. A roller pair position variable means is arranged to change the position of the discharge roller pair with respect to the nip position of the heat roller and press roller in accordance with the temperature of the heat roller, thereby correcting the curl of the recording medium that has passed through the fixing nip portion.

In the prior arts, e.g., the prior arts employed in Japanese Patent Laid-Open Nos. 8-314317 and 8-290857, since curl correction of the recording medium is performed by correcting the recording medium convey path after the recording medium passes through the nip, a power to forcibly deform the recording medium cannot be obtained. If the curl is so large as to hinder conveyance of the recording medium, a sufficiently large correcting effect cannot be obtained.

In double-sided printing, unless the curl after upper surface printing is suppressed to be equal to or smaller than 1 mm, the curl adversely affects an image on the leading end side in lower surface printing. With the conventional arrangement, a sufficiently large correcting effect cannot be obtained.

With the conventional method, a drive mechanism that vertically moves the paper discharge guide or paper discharge roller, and a control mechanism that determines the vertical movement amount and designates it to the drive mechanism are required in order to correct the recording medium convey path.

Accordingly, the fixing device cannot be made compact, and the control operation of the system is complicated.

SUMMARY OF THE INVENTION

It is an object of the present invention to provide a heat roller fixing device which can forcibly correct curl and stably convey a recording medium to improve reliability in conveying the recording medium.

It is another object of the present invention to provide a compact heat roller fixing device in which device control can be simplified.

In order to achieve the above objects of the present invention, there is provided a heat roller fixing device comprising a heat roller, a press roller, and at least one curl correction mechanism, the curl correction mechanism being constituted by three discharge rollers that form a curvilinear nip portion, and the curl correction mechanism being arranged on a recording medium discharge side of a fixing nip portion which is formed at a contact portion between the heat roller and the press roller.

DESCRIPTION OF THE PREFERRED EMBODIMENT

A preferred embodiment of the present invention will be described in detail with reference to the accompanying drawings.

Figure 1:
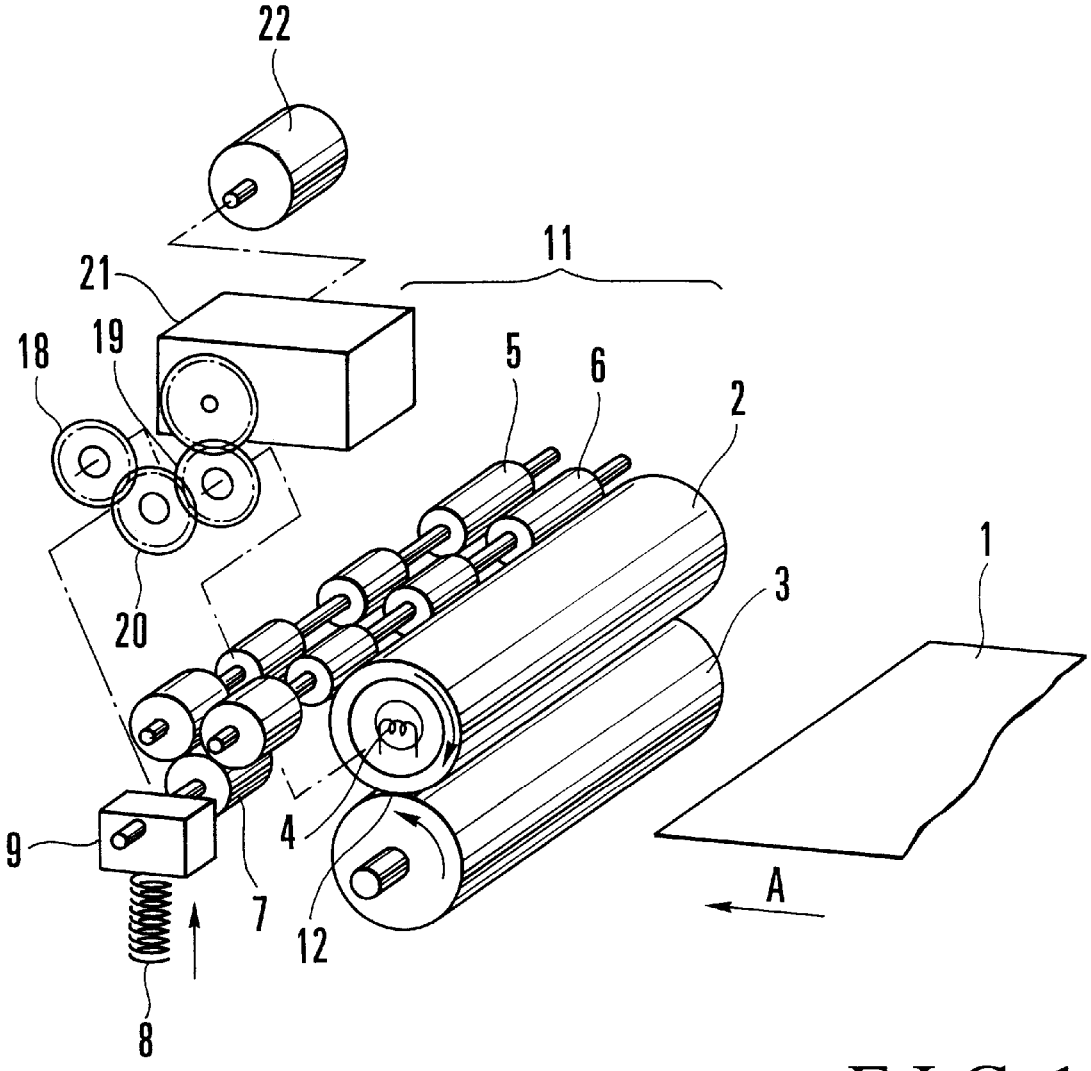
FIG. 1 is a system diagram showing the arrangement of a heat fixing device having a curl correction mechanism according to the present invention.

The arrangement of a heat roller fixing device having a curl correction mechanism will be described with reference to FIG. 1.

The heat roller fixing device having this curl correction mechanism is constituted by a heat roller 2, a press roller 3, and a curl correction mechanism 11. The heat roller 2 is constituted by an aluminum cylinder. A heater 4 is incorporated in the heat roller 2 to heat it to a predetermined temperature. The heat roller 2 has a gear 19 on its shaft. The heat roller 2 is connected to a gear unit 21 driven by a motor 22 and is rotated by it. The press roller 3 is made of a silicone rubber and is arranged such that it comes into contact with the heat roller 2, thus forming a fixing nip portion 12. The press roller 3 is rotated by rotation of the heat roller 2.

The curl correction mechanism 11 is constituted by three rollers, i.e., discharge rollers 5, 6, and 7. These three rollers are arranged, parallel to the heat roller 2, on the recording medium discharge side of the fixing nip portion 12 formed at the contact portion between the heat roller 2 and press roller 3, such that they are closer to the fixing nip portion 12 in the order of the discharge roller 6, the discharge roller 7, and the discharge roller 5.

Of the three discharge rollers, the discharge rollers 5 and 6 are arranged to abut against a surface of a recording medium 1 with which the heat roller 2 comes into contact. The discharge roller 7 is arranged to abut against a surface of the recording medium 1 with which the press roller 3 comes into contact. The discharge roller 7 is urged against the discharge rollers 5 and 6 by a spring 8 through a bearing 9.

Each of the roller portions of the discharge rollers 5 and 6 has a roller diameter of 10 mm to 15 mm, is made of a silicone rubber, and is pressed into a shaft having a diameter of 6 mm.

The roller portion of the discharge roller 7 has a roller diameter of 10 mm to 15 mm, is made of polyoxymethylene, and is pressed into a shaft having a diameter of 6 mm. Thus, depending on the roller diameters selected, the axis-to-axis distance between the first discharge roller 6 and the second discharge roller 5, which are parallel to each other and do not contact each other, can be either smaller than a roller diameter of the third discharge roller 7 or larger than a roller diameter of the third discharge roller 7.

The roller portions of the discharge rollers 5 and 6 need not be made of silicone rubber as far as they are elastic bodies, and the roller portion of the discharge roller 7 need not be made of polyoxymethylene as far as it is made of a resin having almost the same hardness as that of polyoxymethylene.

The discharge rollers 5, 6, and 7 are mounted on a fixing frame (not shown) on which the heat roller 2 is mounted.

A gear 18 is arranged on one side of the shaft of the discharge roller 6, and is connected to the gear 19 of the heat roller 2 through a gear 20. Hence, the discharge roller 6 is rotated by rotation of the heat roller 2.

The discharge roller 7 is rotated as it comes into contact with the discharge roller 6, and the discharge roller 5 is rotated as it comes into contact with the discharge roller 7.

As the recording medium, plain paper PPC of A5 to A3 size having a thickness corresponding to a ream of 55 kg to 70 kg is used.

Figure 2:
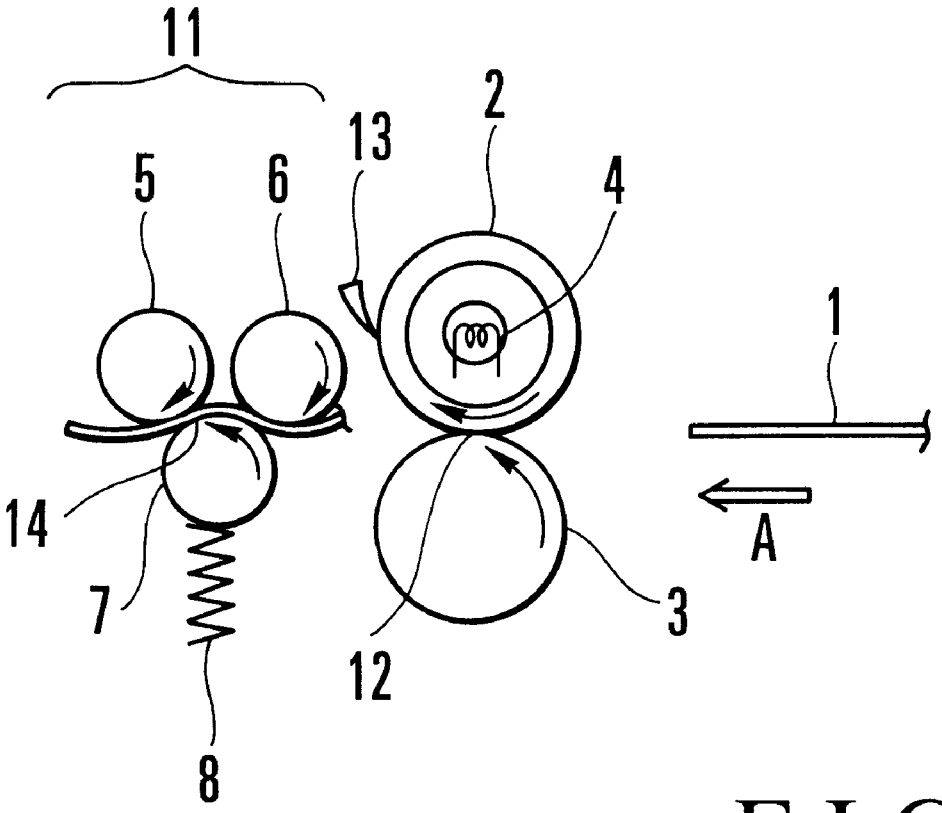
FIG. 2 is an explanatory view showing the operation of the heat fixing device having the curl correction mechanism according to the present invention.

The operation of the heat roller fixing device having this curl correction mechanism will be described with reference to FIG. 2.

The recording medium 1 is conveyed in the direction of an arrow A to reach the fixing nip portion 12 formed by the heat roller 2 and press roller 3. Heat and pressure are applied to the recording medium 1 to fix the non-fixed toner.

The recording medium 1, which has passed through the fixing nip portion 12 due to rotation of the heat roller 2 and press roller 3, curls to the heat roller 2 side.

The curled recording medium 1 is separated from the heat roller 2 by a separator 13, and reaches the first nip portion between the discharge rollers 6 and 7. The recording medium 1, which has passed through the first nip portion between the discharge rollers 6 and 7 due to rotation of the discharge rollers 6 and 7, reaches the second nip portion between the discharge rollers 5 and 7 immediately.

Due to rotation of the discharge rollers 7 and 5, the recording medium 1 passes through the second nip portion between them.

The discharge roller 7 is urged against the discharge rollers 5 and 6 by the spring 8 through the bearing 9. Hence, the recording medium 1 is corrected as it is pressed by a curvilinear nip portion 14, formed by the discharge rollers 6, 7, and 5, in a direction opposite to the curl.

In this embodiment, one curl correction mechanism having a set of three discharge rollers is used. If a plurality of curl correction mechanisms are arranged continuously to locate immediately after the fixing nip portion in the convey direction of the recording medium, higher-quality curl correction can be performed.

As has been described above, with the heat fixing device of the present invention, the recording medium 1 softened by heat and pressure is pressed by the curvilinear nip portion 14, constituted by the discharge rollers 6, 7, and 5, of the curl correction mechanism 11 arranged immediately after the fixing nip portion 12, in a direction opposite to the curl formed by the fixing nip portion 12. The curl correction can accordingly be performed forcibly.

Hence, the curl of the recording medium after fixing can be suppressed to equal to or smaller than 1 mm. Recording medium conveyance is stabilized, and reliability of recording medium conveyance is improved. In double-sided printing, no adverse affect is applied to the image on the leading end side in lower surface printing.

A drive mechanism that vertically moves the paper discharge guide and paper discharge roller, and a control mechanism that determines the vertical movement amount and designates it to the drive mechanism are not required in order to correct the recording medium convey path. The heat fixing device can thus be made compact, and the control operation of the device can be simplified.

What is claimed is:

1. A heat roller fixing device comprising:

a heat roller, a press roller, and at least one curl correction mechanism, said curl correction mechanism being constituted by a plurality of discharge rollers that form a curvilinear nip portion comprising at least a first nip portion and a second nip portion, and said curl correction mechanism being arranged on a discharge side of a fixing nip portion formed at a contact portion between said heat roller and said press roller, wherein said curl correction mechanism is adjacent to said fixing nip portion such that a recording medium discharged from said fixing nip portion is fed directly to said curl correction mechanism.

2. A heat roller fixing device according to claim 1, wherein one of said discharge rollers which is closest to said fixing nip portion in said curl correction mechanism is arranged on the same side where said heat roller is arranged with respect to a recording medium convey path.

3. A heat roller fixing device as claimed in claim 1, wherein said curvilinear nip portion is substantially coplanar to a tangent drawn along said fixing nip portion formed by said heat roller and said press roller.

4. A heat roller fixing device according to claim 1, wherein said curvilinear nip portion is formed by a first, a second, and a third discharge roller, wherein said first discharge roller and said second discharge roller do not come into contact with each other, wherein said third discharge roller is placed between said first discharge roller and said second discharge roller, and wherein said third discharge roller is urged against both said first discharge roller and said second discharge roller.

5. A heat roller fixing device according to claim 4, wherein an axis-to-axis distance between said first discharge roller and said second discharge roller is smaller than a roller diameter of said third discharge roller.

6. A heat roller fixing device according to claim 5, wherein a spring is provided to a shaft of said third discharge roller through a bearing, to apply a desired contact pressure to said first discharge roller and said second discharge roller.

7. A heat roller fixing device according to claim 4, wherein an axis-to-axis distance between said first discharge roller and said second discharge roller is larger than a roller diameter of said third discharge roller.

8. A heat roller fixing device according to claim 7, wherein a spring is provided to a shaft of said third discharge roller through a bearing, to apply a desired contact pressure to said first discharge roller and said second discharge roller.

9. A heat roller fixing device according to claim 1, wherein only one discharge roller of said plurality of discharge rollers disposed adjacent to said fixing nip portion is rotated by a drive mechanism, wherein remaining said plurality of discharge rollers are thereby rotated by the action of said only one discharge roller.

10. A heat roller fixing device comprising:

a heat roller, a press roller, and at least one curl correction mechanism, said curl correction mechanism being constituted by three discharge rollers that form a curvilinear nip portion, and said curl correction mechanism being arranged on a discharge side of a fixing nip portion formed at a contact portion between said heat roller and said press roller, wherein said curvilinear nip portion is formed by arranging first, second, and third discharge rollers such that an axis-to-axis distance between said first and second discharge rollers, which are parallel to each other, is smaller than a roller diameter of said third discharge roller while said first and second discharge rollers do not come into contact with each other, said third discharge roller is placed between said first and second discharge rollers to be parallel thereto, and said third discharge roller is urged against said first and second discharge rollers.

11. A heat roller fixing device according to claim 10, wherein a spring is provided to a shaft of said third discharge roller through a bearing, to apply a desired contact pressure to said first and second discharge rollers.

12. A heat roller fixing device according to claim 10, wherein one of said discharge rollers which is closest to said fixing nip portion is arranged on the same side where said heat roller is arranged with respect to a recording medium convey path.

13. A heat roller fixing device comprising:

a heat roller, a press roller, and at least one curl correction mechanism, said curl correction mechanism being constituted by three discharge rollers that form a curvilinear nip portion, and said curl correction mechanism being arranged on a discharge side of a fixing nip portion formed at a contact portion between said heat roller and said press roller, wherein a drive mechanism for rotating a roller is provided to only one of said discharge rollers which is closest to said fixing nip portion in said curl correction mechanism, and when said closest discharge roller is rotated, remaining ones of said discharge rollers are rotated thereby.

* * * * *